US005967844A

United States Patent [19]

Doutrich et al.

[11] Patent Number: 5,967,844

[45] **Date of Patent: *Oct. 19, 1999**

[54] ELECTRICALLY ENHANCED MODULAR CONNECTOR FOR PRINTED WIRING BOARD

[75] Inventors: Ray C. Doutrich, Lebanon; Stuart C. Stoner, Lewisberry; Peter K. Townsend, Camp Hill; David F. Fusselman, Middletown, all of Pa.

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/417,085

[22] Filed: Apr. 4, 1995

[51] Int. Cl.[6] ..... H01R 13/648

[52] U.S. Cl. ..... 439/607; 439/108

[58] Field of Search ..... 439/607, 609, 439/608, 101, 108, 95

[56] References Cited

U.S. PATENT DOCUMENTS

| | | | |
|---|---|---|---|
| 4,451,107 | 5/1984 | Dola et al. . | |
| 4,601,527 | 7/1986 | Lemke . | |
| 4,655,518 | 4/1987 | Johnson et al. . | |
| 4,808,118 | 2/1989 | Wilson et al. | 439/95 |
| 4,836,791 | 6/1989 | Grabbe et al. | 439/79 |
| 4,869,677 | 9/1989 | Johnson et al. | 439/80 |
| 4,959,024 | 9/1990 | Czeschka | 439/607 |
| 5,110,307 | 5/1992 | Rapoza | 439/566 |
| 5,151,036 | 9/1992 | Fusselman et al. | 439/108 |
| 5,169,324 | 12/1992 | Lemke et al. | 439/101 |
| 5,215,473 | 6/1993 | Brunker et al. | 439/108 |
| 5,277,624 | 1/1994 | Champion et al. | 439/607 |
| 5,316,501 | 5/1994 | Mair | 439/607 |
| 5,336,098 | 8/1994 | Zell et al. | 439/607 |

*Primary Examiner*—Hien Vu
*Attorney, Agent, or Firm*—Daniel J. Long; M. Richard Page

[57] ABSTRACT

An electrical connector for connecting a daughter and a mother printed wiring board. A receptacle is connected to one board on one face and to the header on the other. The header has a conductive housing with opposed end walls and a medial pin receiving wall where it is connected to the other board. The receptacle housing is electrically connected to the header conductive housing by removable springs extending from the end walls of the header housing and separate removable grounding pins extending to a printed wiring board from the medial wall.

19 Claims, 8 Drawing Sheets

ELECTRICALLY ENHANCED MODULAR CONNECTOR FOR PRINTED WIRING BOARD

BACKGROUND OF THE INVENTION

1. Field of the Invention

The present invention relates to electrical connectors and more particularly to modular connectors for use in connecting a daughter printed wiring board to a mother printed wiring board.

2. Brief Description of the Prior Developments

In the manufacture of computers and other various electronic assemblies, daughter boards are commonly connected to mother boards by means of a connector having a receptacle having a plastic housing and a first and second face wherein terminals are connected in one face to the daughter board and at the other to a header connected to the mother board. Various arrangements have been suggested to ground such connectors to the mother or daughter boards but such arrangements have tended to complicate the construction of the connector. A need, therefore, exists for simple and inexpensive means for grounding connectors between mother and daughter boards. There is also a need for such a connector which reduces crosstalk and EMI.

SUMMARY OF THE INVENTION

In the electrical connector of the present invention a receptacle is connected to a daughter board. This receptacle has a housing having a first face and a second face and a plurality of terminals extending from the first face of the daughter board to the second face where there is an interface with a shielded header. The header has two end walls and a medial wall and is comprised of a conductive material, preferable a suitable metallic alloy. A plurality of apertures extend through the medial wall and retain signal pins which contact the terminals in the receptacle. There is a first and second face on the medial wall. The first face interfaces with the second face of the receptacle. The second face abuts the printed wiring board. On the second face there are a plurality of recesses into which conductive pins are press fitted to ground the connector. On the inner side of the end walls of the header there are also axial grooves which retain removable springs which contact shields on the receptacle to further aid in grounding the connector.

DETAILED DESCRIPTION OF THE PREFERRED EMBODIMENT

Figure 1:
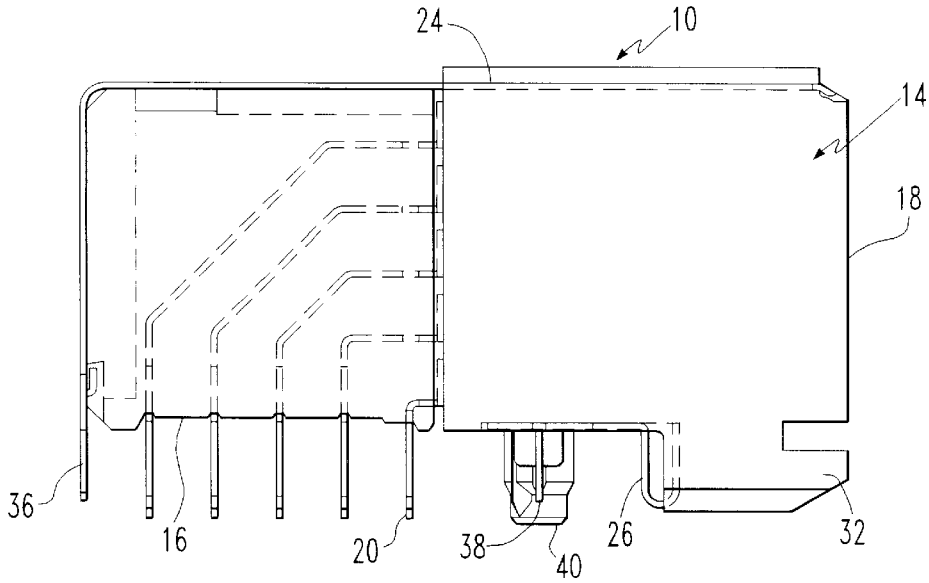
FIG. 1 is a side elevational view of the receptacle element of the connector of the present invention.
Figure 3:
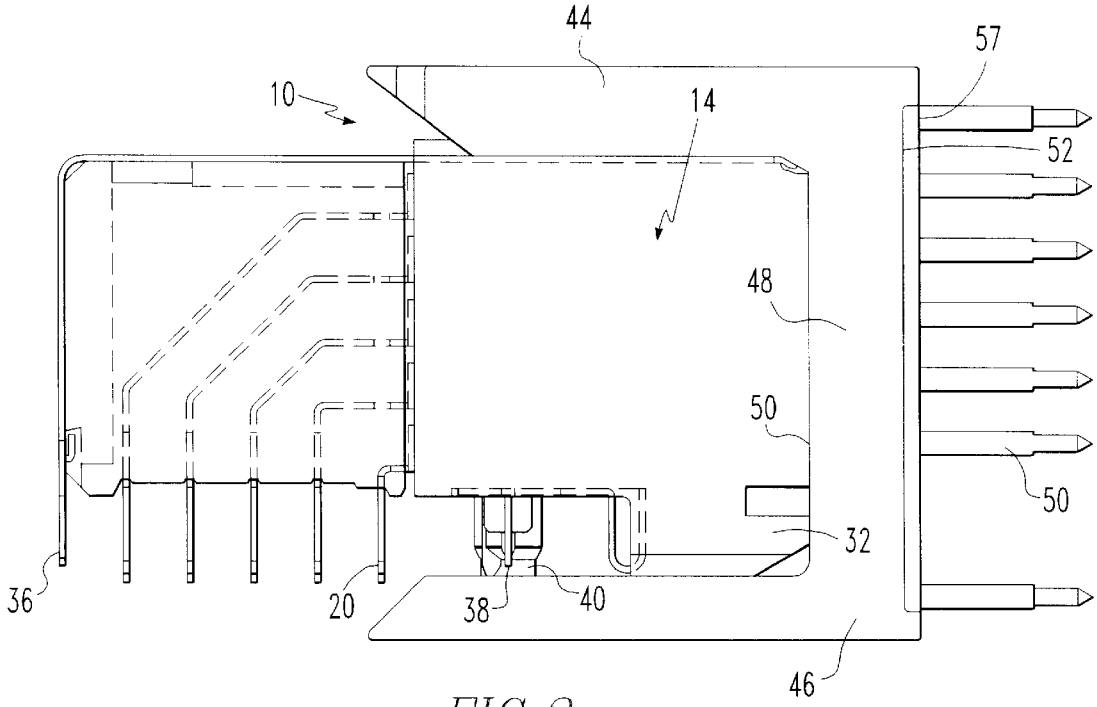
FIG. 3 is a side elevational view of the engaged receptacle and header elements to form the connector of the present invention.
Figure 2:
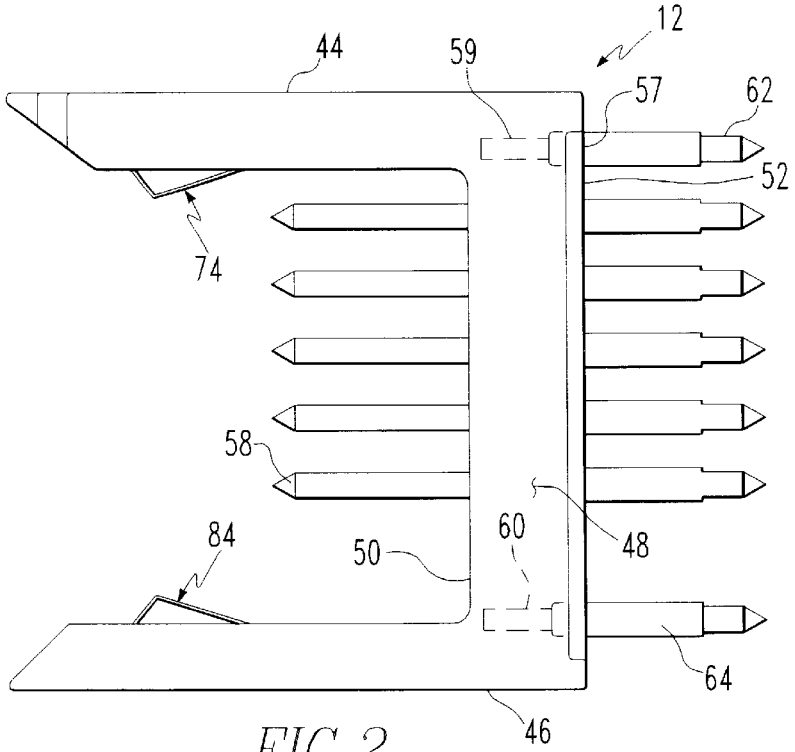
FIG. 2 is a side elevational view of the header element of the connector of the present invention.
Figure 9:
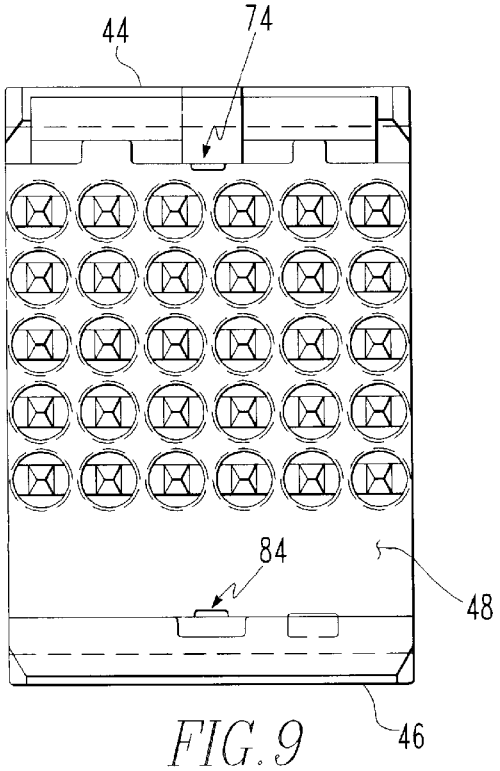
FIG. 9 is a front view of the header shown in FIG. 2.
Figure 4:
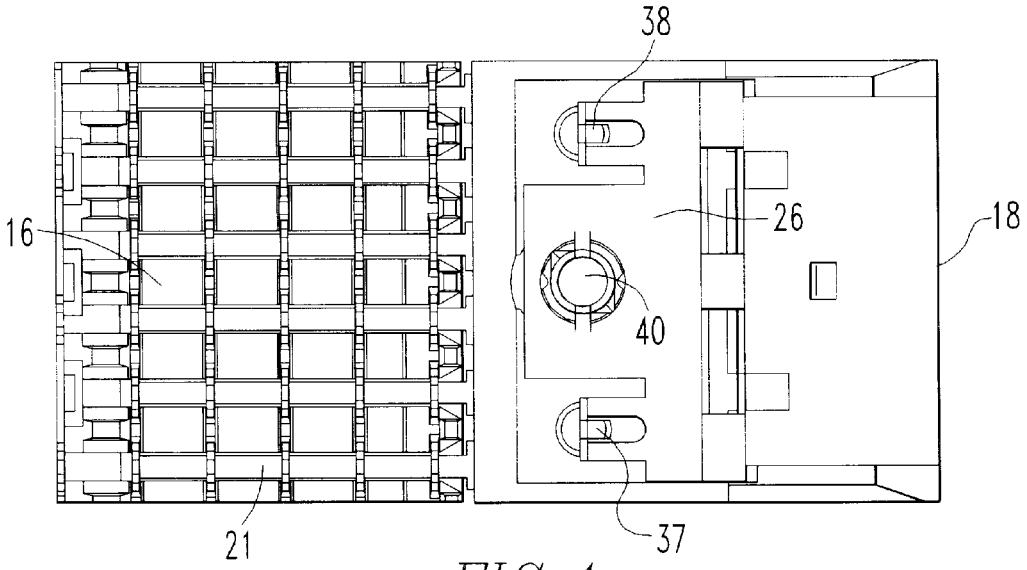
FIG. 4 is a bottom view of the receptacle element shown in FIG. 1.
Figure 7:
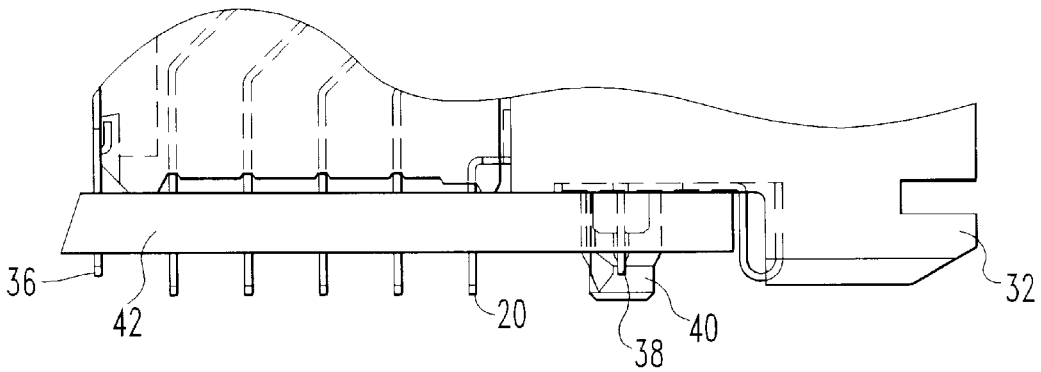
FIG. 7 is a detailed view of a corresponding area in FIG. 3 with the addition of an affixed printed wiring board in fragment.
Figure 5:
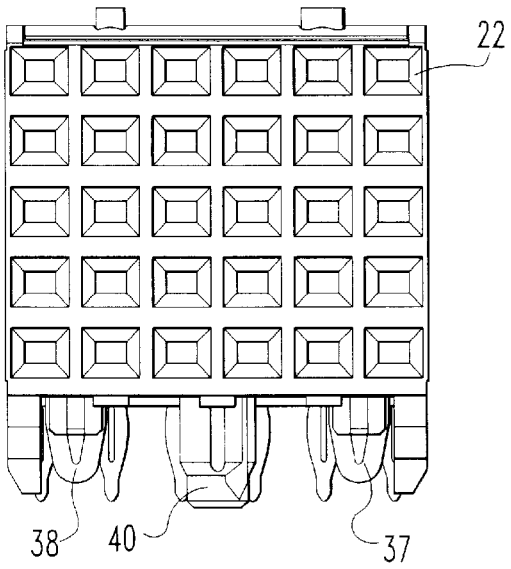
FIG. 5 is a front end view of the receptacle shown in FIG. 1.
Figure 6:
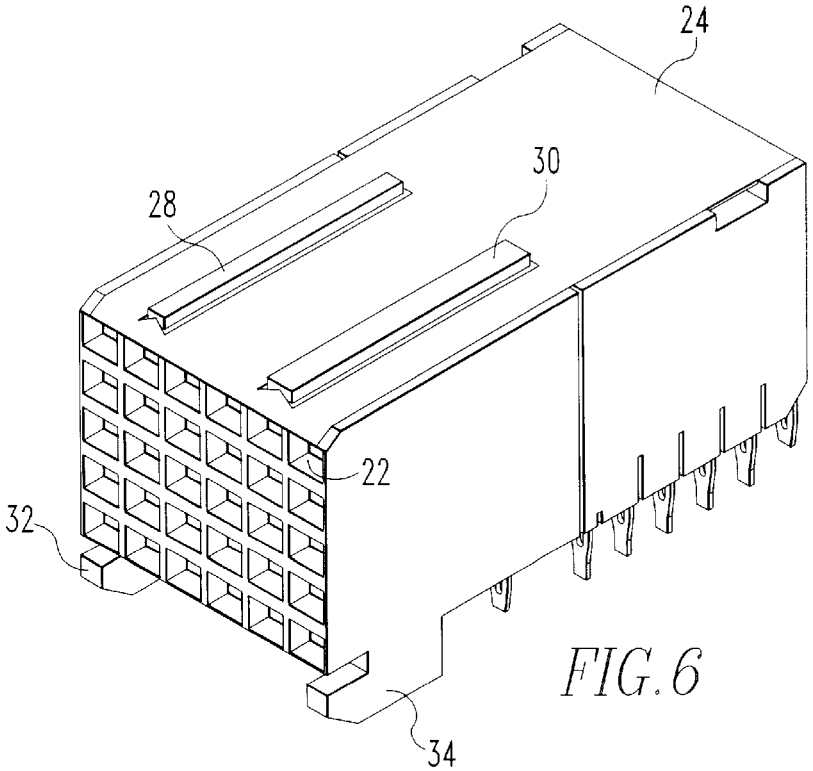
FIG. 6 is a perspective view of the receptacle shown in FIG. 1.
Figure 8:
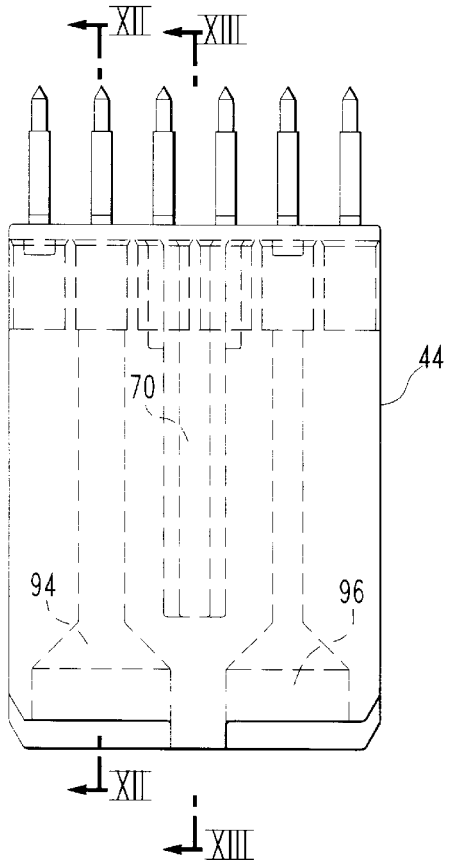
FIG. 8 is a top plan view of the header shown in FIG. 2.
Figure 10:
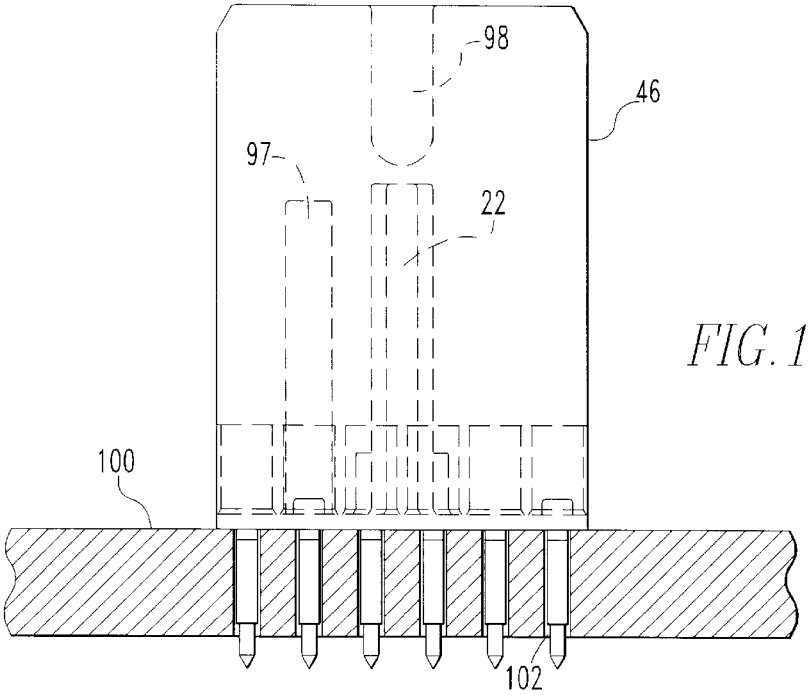
FIG. 10 is a bottom plan view of the header shown in FIG. 2.
Figure 11:
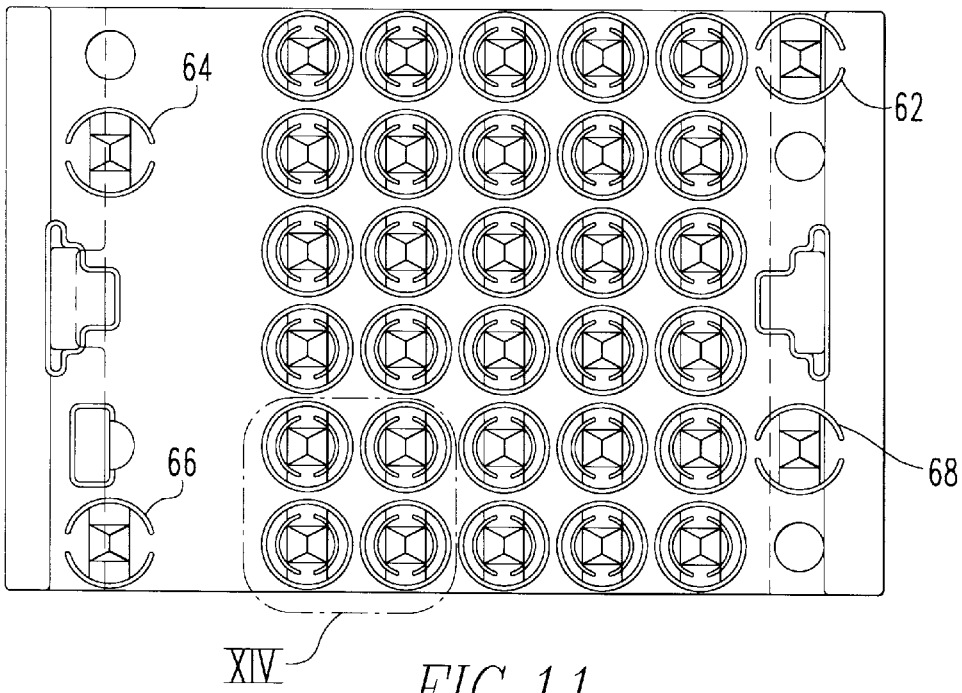
FIG. 11 is a rear view of the header shown in FIG. 2.
Figure 14:
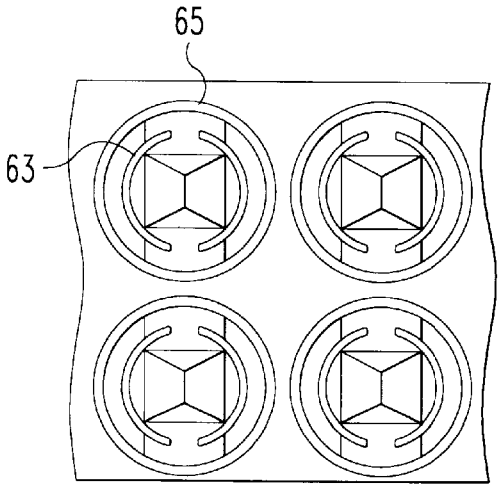
FIG. 14 is a detailed view of the area in circle XIV of FIG. 11.
Figure 12:
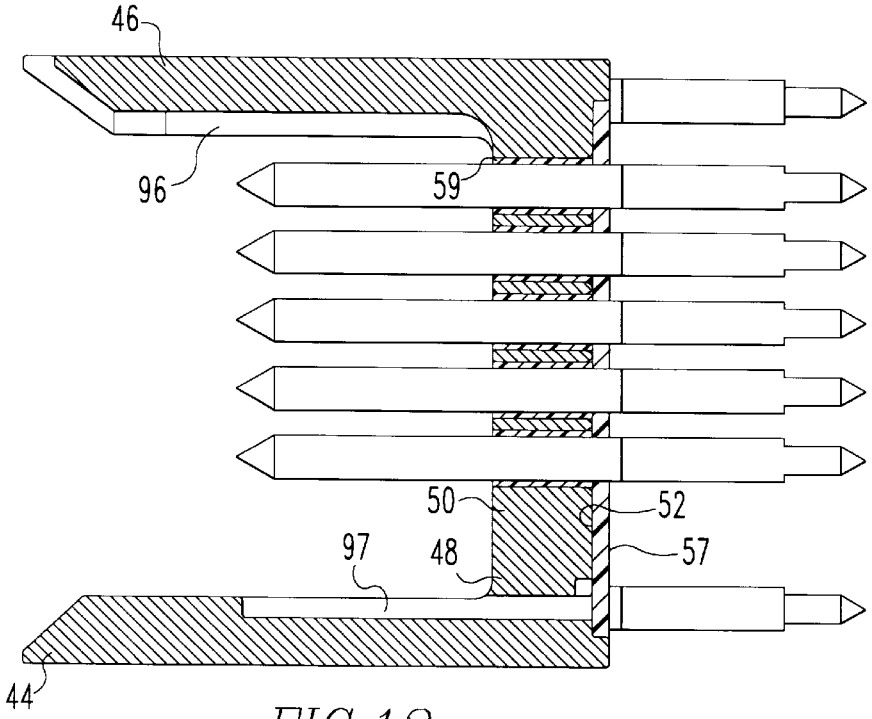
FIG. 12 is a cross sectional view taken through line XII—XII in FIG. 8.
Figure 13:
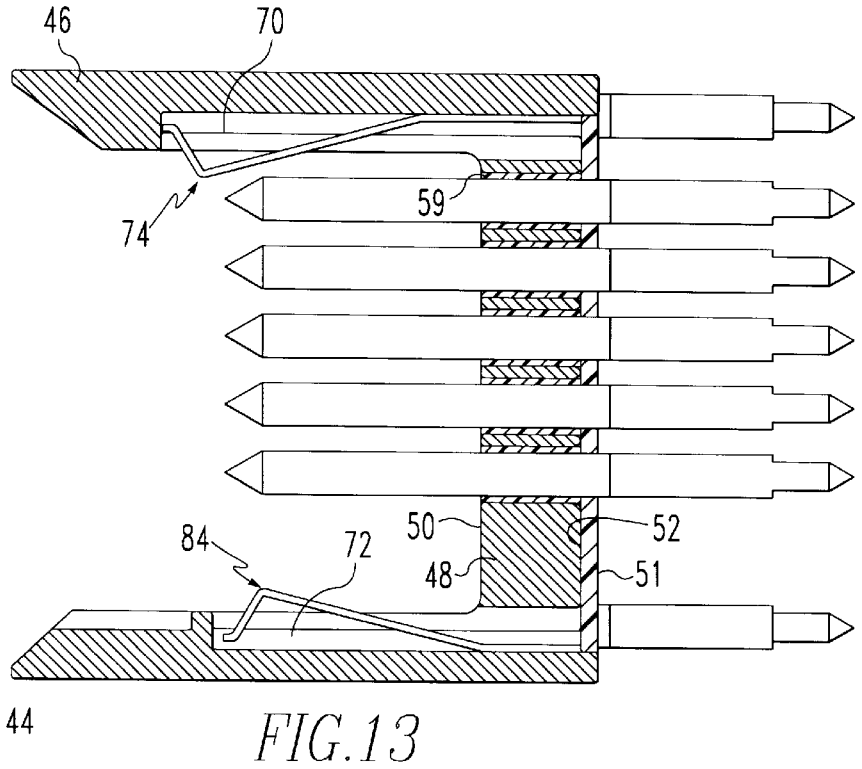
FIG. 13 is a cross sectional view taken through line XIII—XIII in FIG. 8.
Figure 15:
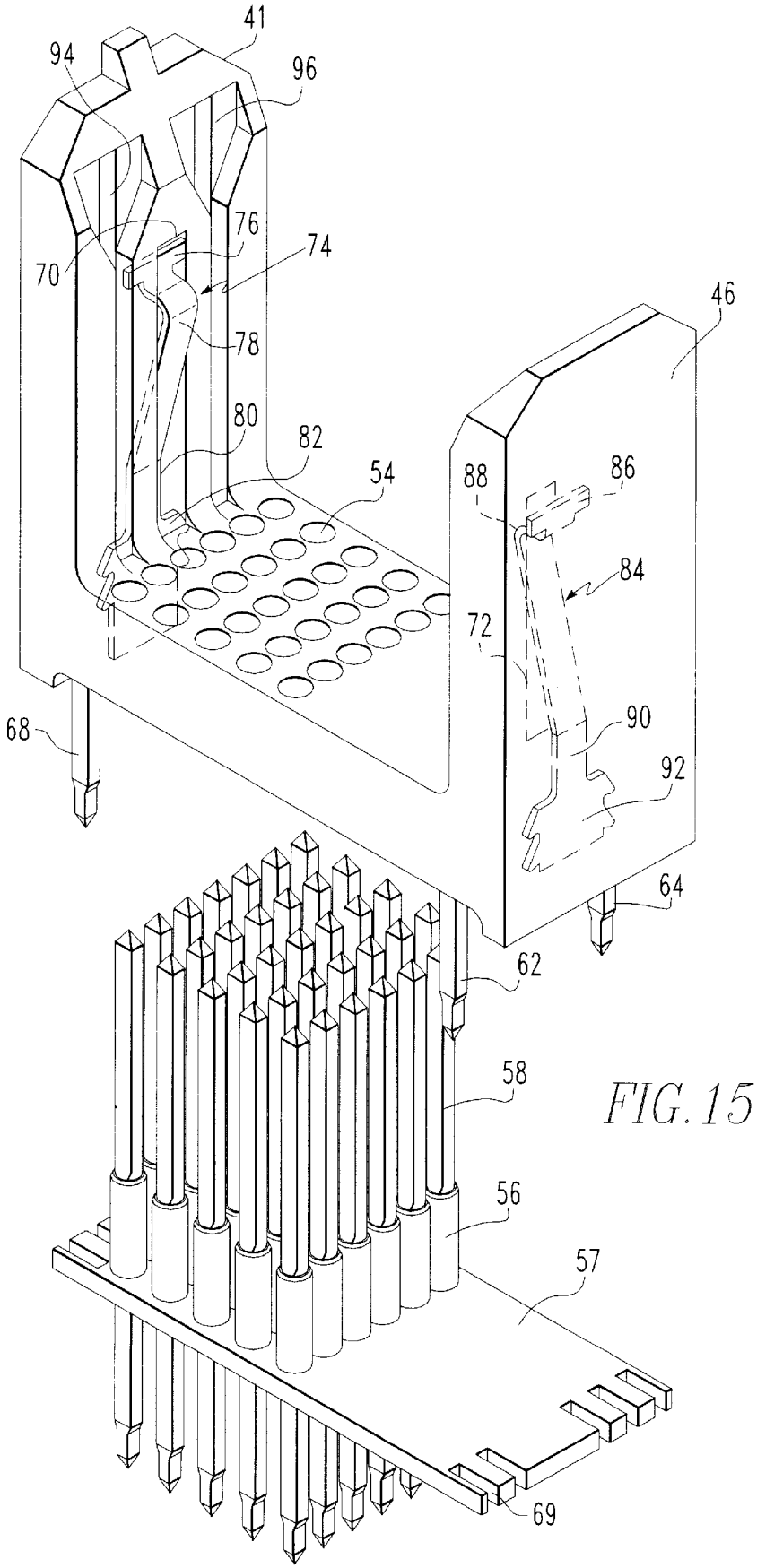
FIG. 15 is a perspective view of the header shown in FIG. 2.

Referring to the figures, the receptacle is shown generally at numeral 10, the shielded header is shown generally at numeral 12. Referring particularly to the FIGS. 1 through 6, the receptacle includes a housing generally at numeral 14 with a first planar face 16, a second planar face 18. Terminals as at 20 extend from the first planar face to the second planar face through passageways as at 21 and then through cavities as at 22. The housing includes top metallic shield 24 and a bottom metallic shield 26. It also includes alignment ribs 28 and 30 and code key holders 32 and 34. Grounding is effected through ground pins 36, 37 and 38 and press peg 40 is used to fix the receptacle to a daughter printed wiring board 42 along with the terminals. Referring particularly to FIGS. 2 and 8 through 15, the header includes end walls 44 and 46 and medial wall 48 which is perpendicularly interposed between the end walls. The medial wall includes a first planar face 50 and a second planar face 52. The header 10 can be die cast of a suitable metallic alloy. Passageways as at 54 extend transversely across the medial wall from the first planar face to the second planar face and are equipped with insulative sleeves as at 56 which are integrated with an insulative plate 57. Conductive signal pins as at 58 extend through these passageways to engage the terminals as at 20 positioned in cavities as 22 in the receptacle. On the second planar face of the medial wall there are recesses as at 59 and 60 which extend only partially through this wall and which receive grounding pins as at 62 and 64 by press fit. As is particularly shown in FIG. 14, the signal pins have shoulder 63 and base insulation rings 65. Other grounding pins 66 and 68 engage other similar recesses in the second planar face of the medial wall. It will be appreciated that additional recesses may be used so that there will be more than one potential position for each grounding pin and so that the grounding pins can be selectively positioned. The grounding pins pass through slots as at 69 in the insulative plate 57. On the inner side of the end walls 44 and 46 there are respectively central vertical grooves 70 and 72. In central vertical groove 70 there is a metallic contact spring 74 which is comprised of a top locking section 76 which engages the side of the groove and is press fit into the groove. A concave section 78 which extends inwardly then back toward the groove, a vertical section 80 and a lower locking section 82 which also engages the groove and which is press fit into the groove. The vertical groove 72 also has a metallic spring 84 which similarly has a top locking section 86, a concave section 88, a vertical section 90 and a lower lock section 92. On each side of the vertical groove 70 there is a lateral vertical groove 94 and 96 which are alignment features that engage ribs 28 and 30 on the receptacle. The spring contacts 74 and 84 are removable from the grooves in which they are mounted and can be optionally used, depending upon the specific characteristics of the receptacle with which they are to be used. The end wall 46 also includes a groove 97 which is useful in the manufacturing of the connector but which has no function thereafter. This end wall also has a recess 98 on its inner side to accommodate the press pin 40. As is particularly shown in FIG. 10, it will be understood that the pins of the header are connected to a mother printed wiring board 100 through apertures as at 102.

The connector as described above is considered to have surprisingly and unexpectantly good crosstalk and EMI reduction characteristics. This connector is also easily and inexpensively grounded to the printed wiring boards to which it is attached.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising a receptacle comprising a housing having a first face and a second face and at least one exterior conductive shield is interposed between said first face and said second face and a plurality of conductive means comprising receptacle contact terminals which extend from said first face of said receptacle to said second face of said receptacle; and a header having a conductive housing comprising a medial wall and generally parallel end walls with opposed inner faces wherein one of said opposed inner faces of the header abuts the exterior conductive shield of the receptacle and a medial wall is interposed between said opposed generally parallel end walls, and said medial wall has a first face and a second face wherein said first face of the medial wall is adjacent to the second face of the receptacle and a plurality of passages extend between the first and second faces of the medial wall and there is a plurality of conductive signal pins and each of said plurality of conductive signal pins passes through one of said passages between the first and second faces of the medial wall to engage a printed wiring board and an insulative plate having a horizontal plane fitted in a groove of said second face of said medial wall with a plurality of insulative sleeves which are integral with said insulative plate and which extend generally perpendicularly therefrom and each of said insulative sleeves is positioned in one of the passages between the first and second faces of the medial wall such that one of said insulative sleeves is interposed between each of said conductive signal pins and the medial wall and a grounding pin is attached to the conductive housing of the header and extends from said conductive housing and passes through the horizontal plane of said insulative plate to engage the printed wiring board.

2. The electrical connector of claim 1 wherein the grounding pin is releasably attached to the conductive housing of the header.

3. The electrical connector of claim 2 wherein the grounding pin comprises at least one conductive pin.

4. The electrical connector of claim 3 wherein the conductive pin is press fit in the ground pin receiving recess.

5. The electrical connector of claim 3 wherein there is a plurality of conductive pins.

6. The electrical connector of claim 3 wherein the conductive pin is fixed in a ground pin receiving recess in the conductive housing of the header.

7. The electrical connector of claim 6 wherein there are a plurality of ground pin receiving apertures positioned on the second face of the medial wall.

8. The electrical connector of claim 6 wherein each of the conductive pins is fixed in a ground pin receiving recess.

9. The electrical connector of claim 8 wherein the conductive pins are press fit in the ground pin receiving recesses.

10. The electrical connector of claim 8 wherein the number of ground pin receiving recesses exceeds the number of ground pins so that the ground pins can be selectively positioned.

11. The electrical connector of claim 9 wherein the ground pin receiving recess is on the medial wall.

12. The electrical connector of claim 11 wherein the ground pin receiving recess is positioned on the second face of the medial wall.

13. The electrical connector of claim 1 wherein conductive means connect the exterior conductive shield of the housing of the receptacle and at least one end wall of the conductive housing of the header.

14. The electrical connector of claim 13 wherein the conductive means connecting the exterior conductive shield to at least one of the end walls of the conductive housing of the header are resilient conductive means.

15. The electrical connector of claim 14 wherein the resilient conductive means comprises a pair of opposed metal springs which extend inwardly from both of the opposed inner faces of the end walls of the housing of the header to contact the exterior conductive shield of the receptacle.

16. The electrical connector of claim 15 wherein the opposed metal springs are removable from the opposed inner faces of the end walls of the housing of the header.

17. The electrical connector of claim 15 wherein the metal springs are removably attached to the end walls.

18. The electrical connector of claim 1 wherein the conductive signal pins and the grounding means of the header are attached to a printed wiring board.

19. The electrical connector of claim 18 wherein the conductive means of the receptacle is attached to a printed wiring board.

* * * * *